US010711454B2

(12) United States Patent
Sorkin

(10) Patent No.: US 10,711,454 B2
(45) Date of Patent: Jul. 14, 2020

(54) CAP FOR ANCHOR OF POST-TENSION ANCHORAGE SYSTEM

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 262 days.

(21) Appl. No.: 15/887,492

(22) Filed: Feb. 2, 2018

(65) Prior Publication Data

US 2018/0155923 A1 Jun. 7, 2018

Related U.S. Application Data

(62) Division of application No. 14/715,934, filed on May 19, 2015, now Pat. No. 9,926,698.

(60) Provisional application No. 62/000,419, filed on May 19, 2014.

(51) Int. Cl.

| | |
|---|---|
| ***E04C 5/12*** | (2006.01) |
| ***E04B 1/66*** | (2006.01) |
| ***E04C 5/16*** | (2006.01) |
| *E04G 17/07* | (2006.01) |

(52) U.S. Cl.

CPC ..... *E04B 1/66* (2013.01); *E04C 5/12* (2013.01); *E04C 5/122* (2013.01); *E04C 5/16* (2013.01); *E04G 17/0707* (2013.01)

(58) Field of Classification Search

CPC . E04B 1/66; E04C 5/122; E04C 5/125; E04C 5/12

USPC ..... 52/223.6, 223.9, 223.13, 223.14, 745.21

See application file for complete search history.

(56) References Cited

U.S. PATENT DOCUMENTS

| | | | | | |
|---|---|---|---|---|---|
| 4,773,198 | A * | 9/1988 | Reinhardt | E04C 5/122 | 52/223.13 |
| 4,896,470 | A * | 1/1990 | Sorkin | B29C 45/14 | 52/223.13 |
| 4,918,887 | A * | 4/1990 | Davis | E04C 5/122 | 52/223.13 |
| 5,024,032 | A * | 6/1991 | Rodriguez | E04C 5/12 | 24/122.6 |
| 5,072,558 | A * | 12/1991 | Sorkin | B29C 45/14 | 52/223.13 |
| 5,440,842 | A * | 8/1995 | Sorkin | E04C 5/12 | 52/223.13 |
| 5,755,065 | A * | 5/1998 | Sorkin | E04C 5/12 | 52/223.13 |
| 5,897,102 | A * | 4/1999 | Sorkin | E04C 5/12 | 249/43 |
| 6,023,894 | A * | 2/2000 | Sorkin | E04C 5/122 | 24/122.6 |

(Continued)

*Primary Examiner* — Kyle J. Walraed-Sullivan

(74) *Attorney, Agent, or Firm* — Adolph Locklar

(57) ABSTRACT

The process includes forming a concrete form at least one end wall where the concrete form is adapted to receive concrete placed thereinto. The process also includes setting a fixed end anchor and a tensioning end anchor on at least one end wall where the fixed end anchor and tensioning end anchor are each adapted to receive a tendon. The process further includes threading the tendon through the fixed end anchor and tensioning end anchor such that a tensioning end portion of the tendon extends from the tensioning end anchor and placing concrete into the concrete form. The process includes installing a cap about the circumference of the tensioning end portion of the tendon. The cap includes a cap body. The cap body includes an inner bore, where the inner bore has a diameter corresponding to the outer diameter of the tendon.

19 Claims, 8 Drawing Sheets

(56) References Cited

U.S. PATENT DOCUMENTS

| | | | | |
|---|---|---|---|---|
| 6,354,596 | B1 * | 3/2002 | Rodriguez | E04C 5/12<br>174/153 G |
| 6,631,596 | B1 * | 10/2003 | Sorkin | E04C 5/12<br>24/122.6 |
| 7,424,792 | B1 * | 9/2008 | Sorkin | E04C 5/122<br>52/223.13 |
| 2002/0178665 | A1 * | 12/2002 | Campbell | E04C 5/08<br>52/223.13 |

* cited by examiner

CAP FOR ANCHOR OF POST-TENSION ANCHORAGE SYSTEM

CROSS-REFERENCE TO RELATED APPLICATIONS

This application is a divisional application which claims priority from U.S. utility application Ser. No. 14/715,934, filed May 19, 2015 which is itself a nonprovisional application that claims priority from U.S. provisional application No. 62/000,419, filed May 19, 2014, which is hereby incorporated by reference in its entirety.

TECHNICAL FIELD/FIELD OF THE DISCLOSURE

The present invention relates generally to post-tension anchorage systems. More particularly, the present invention relates to caps that are used for sealing an exposed end of an anchor having a tendon extending through the anchor.

BACKGROUND OF THE DISCLOSURE

Structural concrete, though capable of carrying very high compressive loads, is generally weak in carrying tensile loads on its own. Reinforced concrete ameliorates this deficiency by including an internal structure formed from materials capable of withstanding tensile forces within an otherwise solid concrete structure. Metal bars or cables are often used due to their high tensile strength and relative ease of manufacture.

In order to further improve the tensile capacities of reinforced concrete structures, the reinforcement structure may be pre- or post-tensioned. Added structural tension maintains a compression loading on the concrete member, even when tensile stress would otherwise occur (such as in beam-loading). In post-tensioned concrete, the reinforcing structure is tensioned after the concrete has set.

SUMMARY

The present disclosure provides for a process. The process includes forming a concrete form including an end wall. The concrete form may be adapted to receive concrete placed thereinto. The process also includes coupling a tensioning end anchor to the end wall. The tensioning end anchor may be adapted to receive a tendon through an interior channel thereof. The process also includes threading the tendon through the tensioning end anchor such that a tensioning end portion of the tendon extends from the tensioning end anchor. The process also includes placing concrete into the concrete form. The process also includes threading the tensioning end portion of the tendon through a cap. The cap may include a generally annular cap body. The cap body may have an inner bore formed therethrough. The process also includes moving the cap along the tensioning end portion of the tendon until the cap abuts the tensioning end anchor. The process also includes inhibiting fluid intrusion into the interior channel of the tensioning end anchor with the cap. The process also includes removing the cap from the tensioning end portion of the tendon.

The present disclosure also provides for a system for anchoring a tendon for use in a post-tensioned concrete member. The system may include a tensioning end anchor adapted to receive the tendon through an interior channel thereof. The tensioning end anchor may include a front extension. The tensioning end anchor may be positioned within the concrete member such that the front extension is generally positioned at an edge of the concrete member. The system may also include a cap. The cap may include a cap body. The cap body may include an inner bore formed therethrough. The cap may be positioned to cover the end of the front extension of the tensioning end anchor.

The present disclosure also provides for a process. The process may include providing a tensioning end anchor positioned in a concrete member. The tensioning end anchor may be adapted to receive a tendon through an interior channel thereof. The process may include threading the tendon through the tensioning end anchor such that a tensioning end portion of the tendon extends from the tensioning end anchor. The process may include positioning a cap around the tendon in abutment with the tensioning end anchor. The cap may include a cap body having an inner bore formed therethrough through which the tendon extends. The process may include inhibiting fluid intrusion into the interior channel of the tensioning end anchor with the cap. The process may include removing the cap from the tendon.

The present disclosure also provides for a system for inhibiting fluid entry into a tendon for use in a post-tensioned concrete member during the construction cycle to protect the tendon from outside elements. The system may include a tensioning end anchor and a cap. The tensioning end anchor may be adapted to receive the tendon through an interior channel thereof. The tensioning end anchor may include a front extension. The tensioning end anchor may be positioned within the concrete member such that the front extension is generally positioned at an edge of the concrete member. The cap may include a cap body. The cap body may have an inner bore formed therethrough. The cap may be adapted to abut and cover the end of the front extension of the tensioning end anchor.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
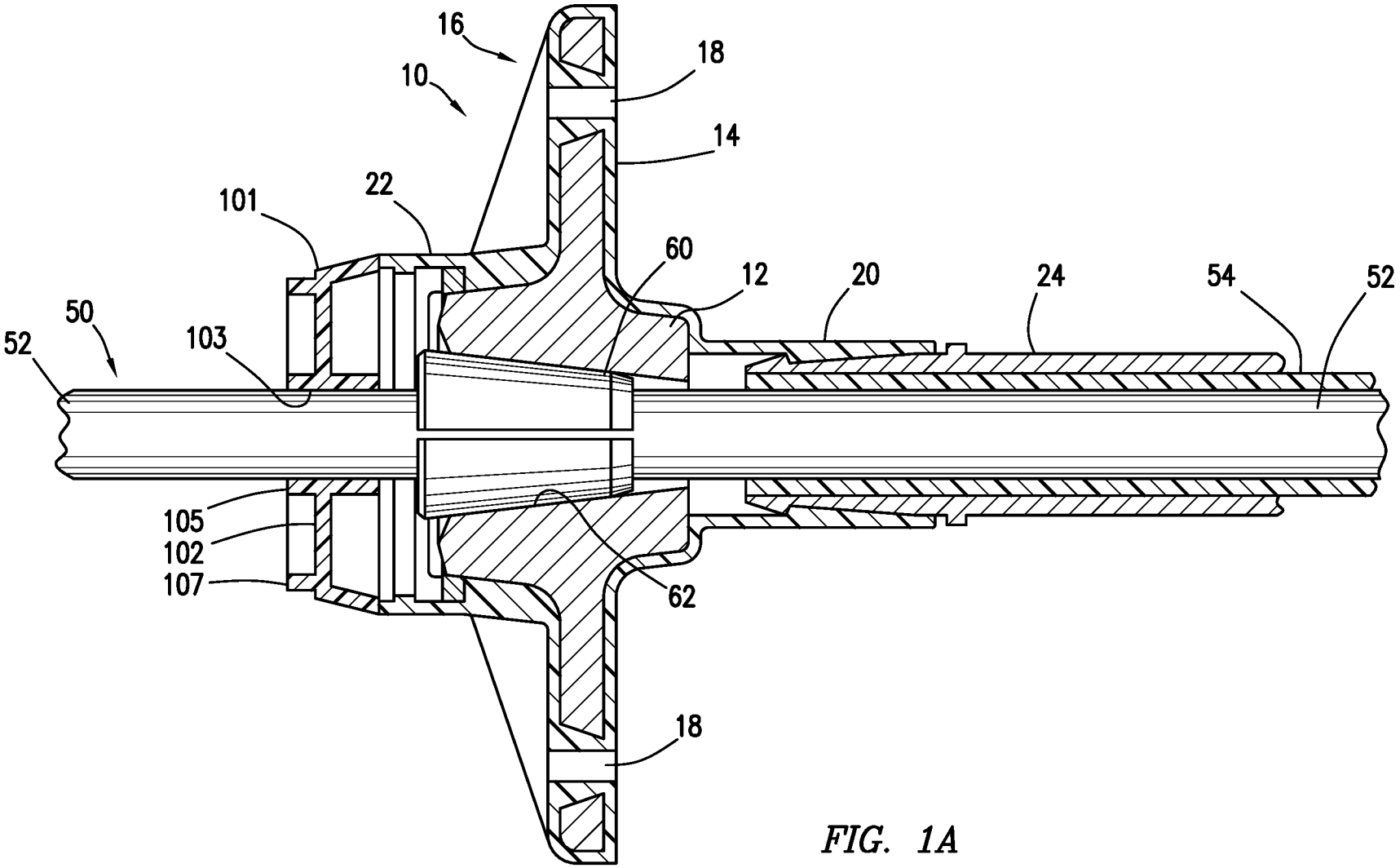
FIG. 1A is a cross section view of an anchor for post-tensioned concrete members fitted with a cap consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

In one embodiment of the present disclosure, a series of tension cables wrapped in sheathes are placed within a concrete form, each positioned parallel to the desired tensile pre-loading. The concrete form may be made up of one or more form walls positioned to hold the concrete as it sets and may define the shape of the final concrete member. The tension cables may pass through one of the form walls defining an end wall. The sheath allows each tension cable to move within the surrounding concrete during tensioning. A fixed end anchor may be positioned at one end of the cable and a tensioning anchor placed at the other end. FIG. 1A depicts tensioning anchor 10 for use with a post-tensioned concrete member (not shown). Tensioning anchor 10 includes anchor body 12. In some embodiments, anchor body 12 may be surrounded by encapsulation 14. Encapsulation 14 may, in some embodiments, include flange 16, mounting holes 18, rear extension 20, and front extension 22. In some embodiments, flange 16 may be positioned to spread the tensile loading into a wider cross-section of the concrete member. Rear extension 20 may be positioned to receive corrosion prevention tubing 24 positioned to, for example, reduce the amount of concrete entering the interior of tensioning anchor 10. Tensioning anchor 10 may include an interior channel through which the cable may extend.

Prior to placing or pouring the concrete into the concrete form, the fixed end anchor may be positioned in the concrete form and tensioning anchor 10 may be coupled to the end wall. Tendon 50 may be threaded through fixed end anchor and tensioning anchor 10. As shown in FIG. 1A, anchor body 12 may be positioned to receive tendon 50. Tendon 50 may, in some embodiments, include tension cable 52. In some embodiments, tension cable 52 may be a metal cable positioned to post-tension the concrete member. Tendon 50 may also include sheath 54 positioned about tension cable 52 which, in some embodiments, reduces the amount of concrete that comes into direct contact with tension cable 52, thus allowing tension cable 52 to move within the concrete member as it is tensioned.

Figure 1B:
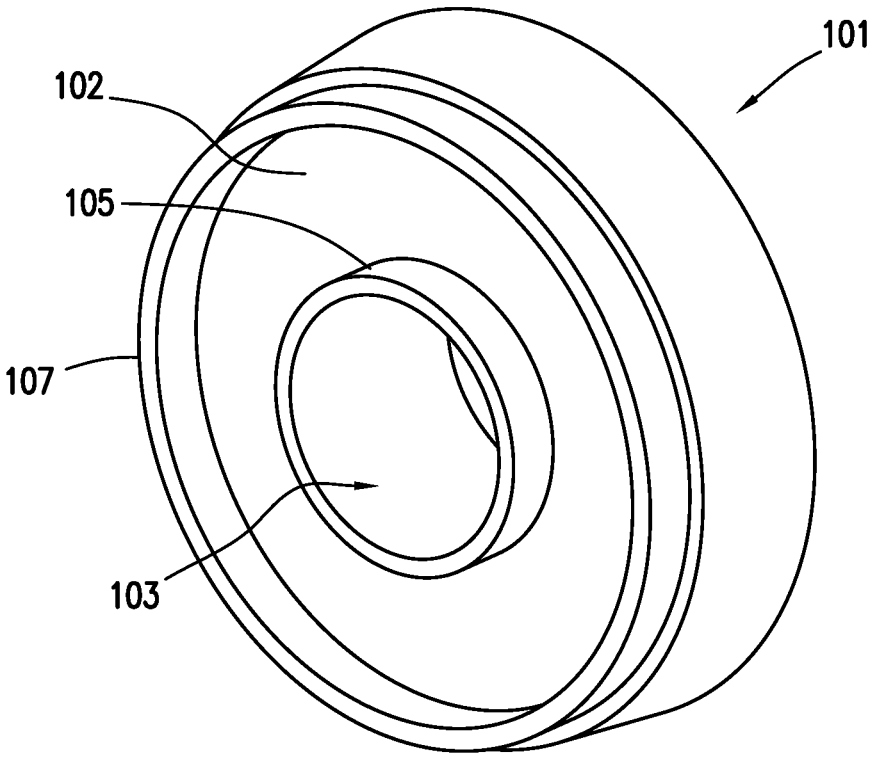
FIG. 1B is a perspective view of the cap of FIG. 1A.

After the concrete is placed into the concrete form and prior to tensioning, tendon 50 may be exposed and therefore open to corrosive fluids such as water at tensioning anchor 10. As depicted in FIGS. 1A and 1B, in some embodiments, cap 101 may be positioned about tendon 50 such as by threading tendon 50 through cap 101 so that front extension 22 of tensioning anchor 10 is covered and closed from the surrounding environment, inhibiting or limiting fluid entry into anchor 10 and protecting the interior from outside elements. Although discussed with regard to tendon 50, one having ordinary skill in the art with the benefit of this disclosure will understand that in some embodiments, a portion of sheath 54 may be removed from the end of tendon 50, such that only tension cable 52 may pass through cap 101. Cap 101 may include cap body 102. In some embodiments, cap body 102 may be generally annular in shape having inner bore 103 formed therethrough. One having ordinary skill in the art with the benefit of this disclosure will understand that cap body 102 may have any shape adapted to operate as herein described and may be other than circular without deviating from the scope of this disclosure. Inner bore 103 may be adapted to allow tendon 50 to pass through cap body 102. In some embodiments, inner bore 103 has a diameter that is approximately that of tendon 50 so that, for example, a press fit, friction fit, or close fit therebetween may be achieved. In some embodiments, as depicted in FIGS. 1A and 1B, cap 101 may include inner flange 105. Inner flange 105, as depicted, extends from cap 101 along the side of tendon 50. In some embodiments, cap 101 may further include outer flange 107 which, as depicted, may extend from cap 101 on the outer edge of cap 101. Inner flange 105 and outer flange 107 may, for example, assist with inhibiting or limiting fluid intrusion between tension cable 52 and sheath 54. In some embodiments, cap 101 may abut the face of front extension 22 of tensioning anchor 10 as depicted in FIG. 1A, by, for example, frictional force with tendon 50. Cap 101 may thus abut against anchor 10 to impair or prevent fluid intrusion into the interior channel of tensioning anchor 10 or between tension cable 52 and sheath 54 of tendon 50.

Figure 2A:
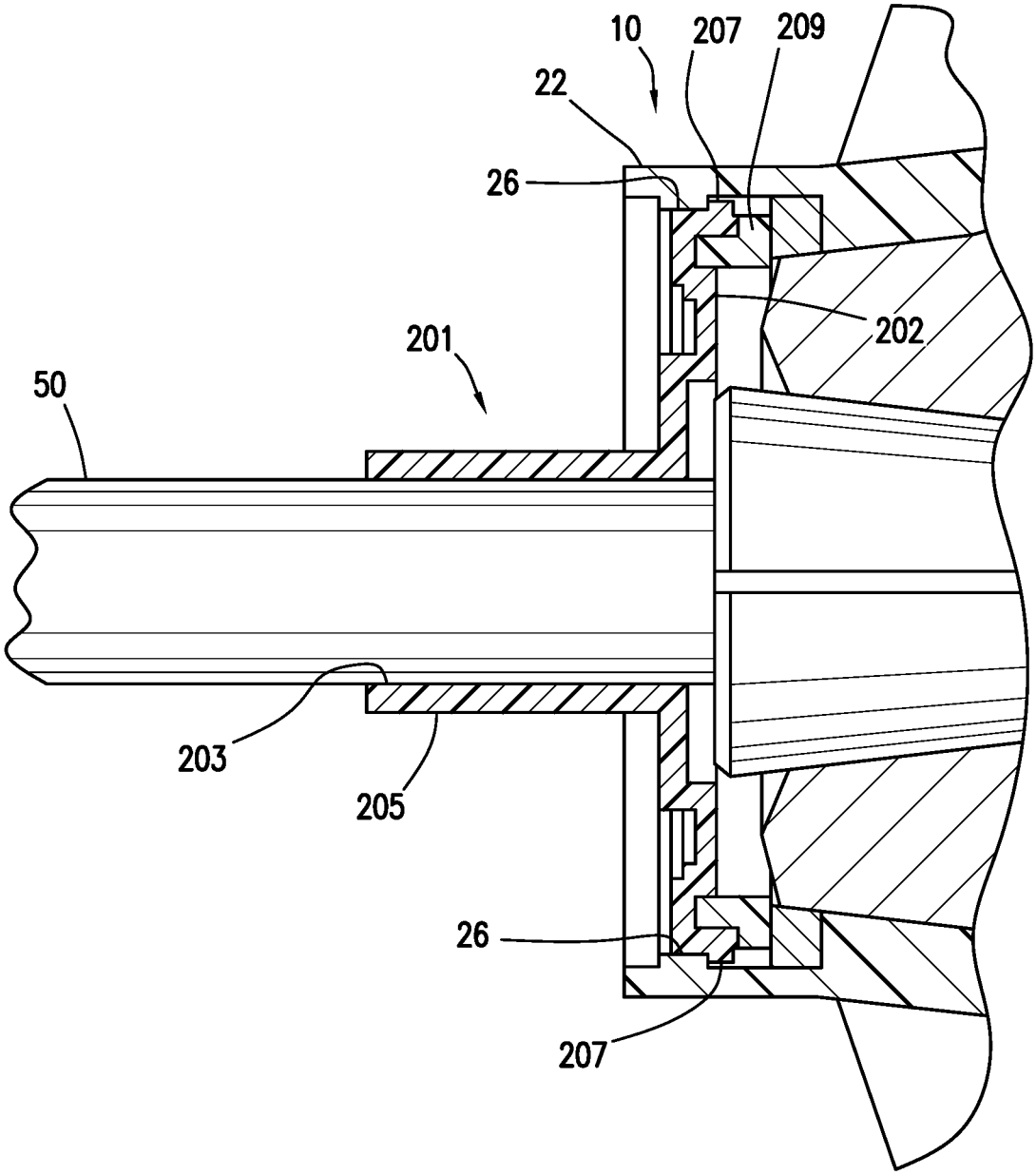
FIG. 2A is a partial cross section view of an anchor for post-tensioned concrete members fitted with a cap consistent with at least one embodiment of the present disclosure.
Figure 2B:
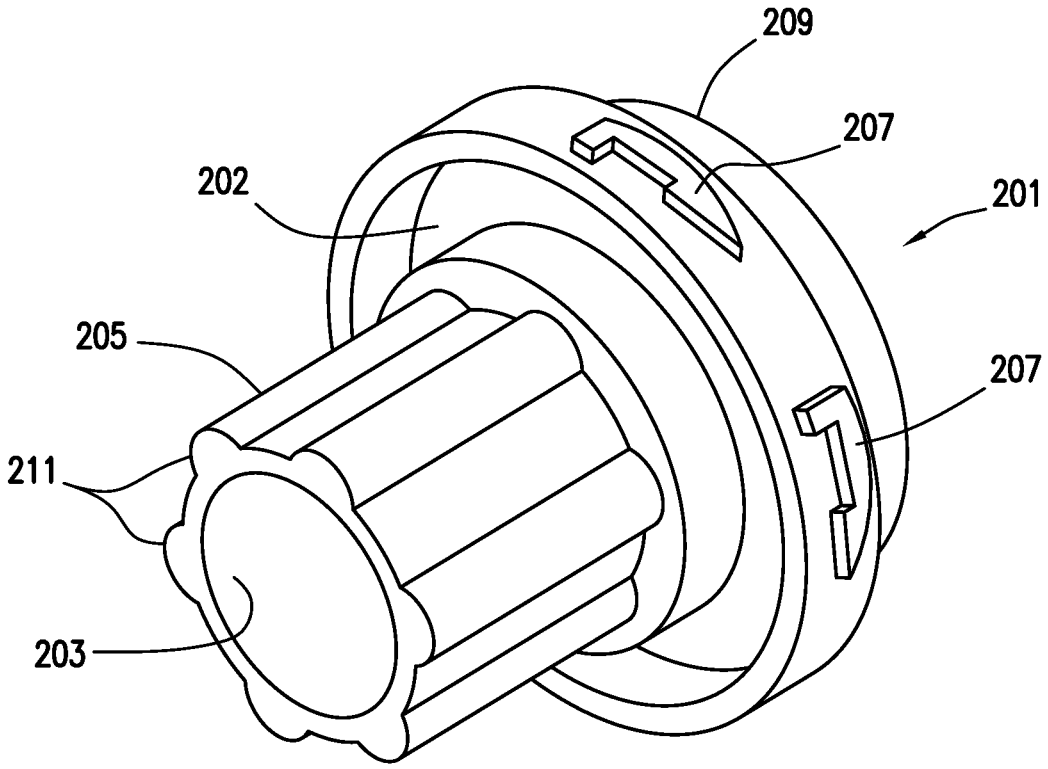
FIG. 2B is a perspective view of the cap of FIG. 2A.

In some embodiments, as depicted in FIGS. 2A and 2B, cap 201 is positioned about tendon 50 so that front extension 22 of tensioning anchor 10 is covered and closed from the surrounding environment. Cap 201 may include cap body 202. In some embodiments, cap body 202 may be generally annular in shape having inner bore 203 formed therethrough. One having ordinary skill in the art with the benefit of this disclosure will understand that cap body 202 may have any shape adapted to operate as herein described and may be other than circular without deviating from the scope of this disclosure. Inner bore 203 may be adapted to allow tendon 50 to pass through cap body 202. In some embodiments, inner bore 203 has a diameter that is approximately that of tendon 50 so that, for example, a press fit, friction fit, or close fit therebetween may be achieved. In some embodiments, cap 201 may include inner flange 205. Inner flange 205, as depicted, extends from cap 201 along the side of tendon 50. Inner flange 205 may, for example, assist with preventing or impairing fluid intrusion into the interior channel of tensioning anchor 10 or tendon 50.

In some embodiments, cap 201 may be coupled to front extension 22 of tensioning anchor 10. As depicted in FIG. 2B, cap 201 may include one or more bayonet ramps 207 positioned to interlock with one or more bayonet ramps 26 formed on the inner surface of front extension 22 of tensioning anchor 10. One having ordinary skill in the art with the benefit of this disclosure will understand that although a bayonet ramp based coupler is described, cap 201 may be coupled to front extension 22 by any acceptable method, including without limitation a bayonet ramp, threaded connection, discontinuous threaded connection, etc. In some embodiments, cap 201 may include one or more features to assist rotation thereof. As depicted in FIG. 2B, cap 201 includes raised ridges 211 on inner flange 205 positioned to, for example, allow a wrench to turn cap 201 to engage or disengage cap 201 from front extension 22. One having ordinary skill in the art with the benefit of this disclosure will understand that although raised ridges 211 are depicted, any other feature for turning cap 201 may be substituted without deviating from the scope of this disclosure. Rotation features may include, without limitation, raised ridges formed on the exterior of inner flange 205; square, hexagonal, splined, or other polygonal protrusion outer surface of inner flange 205; one or more wrenching points formed on inner flange 205; or one or more holes positioned on cap 201 positioned to accept a spanner tool.

In some embodiments, cap 201 has an outer diameter substantially the same as the inner diameter of front extension 22 so that cap 201 fits tightly into front extension 22, allowing for, for example, a fluid seal therebetween to impair or prevent fluid intrusion into the interior channel of tensioning anchor 10 or between tension cable 52 and sheath 54 of tendon 50. In some embodiments, cap 201 may further include seal 209 positioned to, for example, further enhance the seal between cap 201 and front extension 22.

Figure 3A:
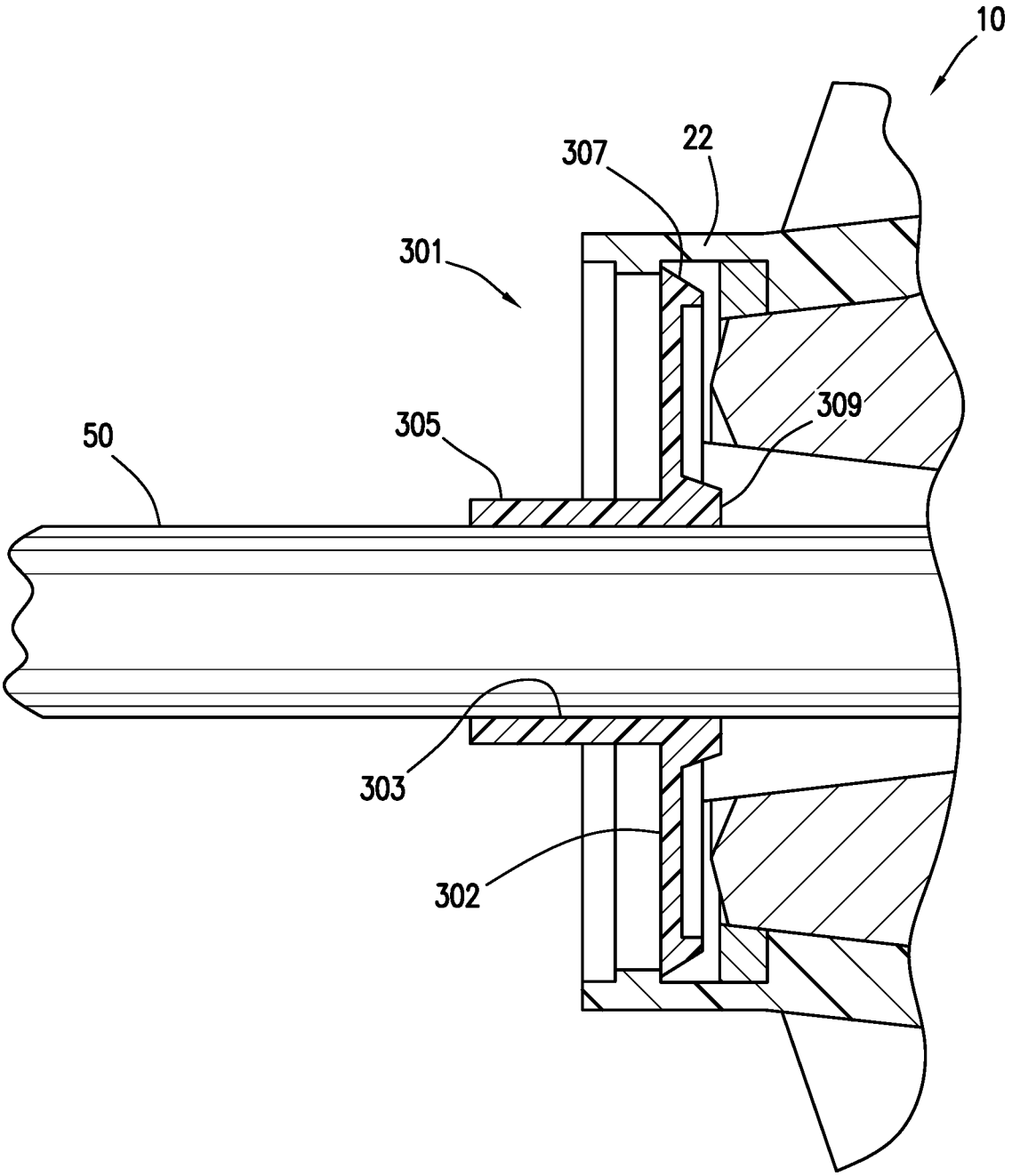
FIG. 3A is a partial cross section view of an anchor for post-tensioned concrete members fitted with a cap consistent with at least one embodiment of the present disclosure.
Figure 3B:
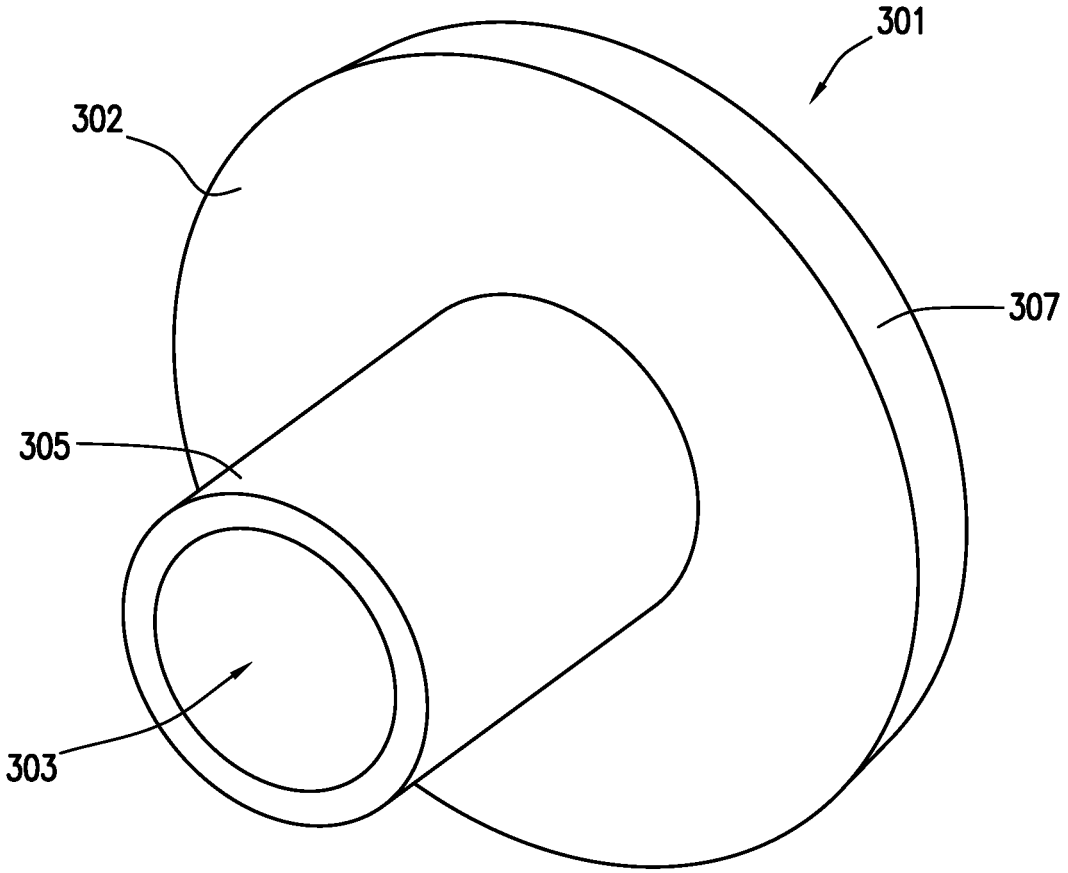
FIG. 3B is a perspective view of the rear of the cap of FIG. 3A.

In some embodiments, as depicted in FIGS. 3A and 3B, cap 301 is positioned about tendon 50 so that front extension 22 of tensioning anchor 10 is covered and closed from the surrounding environment. Cap 301 may include cap body 302. In some embodiments, cap body 302 may be generally annular in shape having inner bore 303 formed therethrough. One having ordinary skill in the art with the benefit of this disclosure will understand that cap body 302 may have any shape adapted to operate as herein described and may be other than circular without deviating from the scope of this disclosure. Inner bore 303 may be adapted to allow tendon 50 to pass through cap body 302. In some embodiments, inner bore 303 has a diameter that is approximately that of tendon 50 so that, for example, a press fit, friction fit, or close fit therebetween may be achieved. In some embodiments, cap 301 may include inner flange 305. Inner flange 305, as depicted, extends from cap 301 along the side of tendon 50. In some embodiments, cap 301 may further include outer flange 307 which, as depicted, may extend from cap 301 on the outer edge of cap 301. Inner flange 305 and outer flange 307 may, for example, impair or prevent fluid intrusion the interior channel of tensioning anchor 10 or tendon 50. In some embodiments, the outer diameter of cap 301 is substantially the same as the inner diameter of front extension 22 of tensioning anchor 10. Cap 301 may thus fit tightly into front extension 22, allowing for, for example, a fluid seal therebetween, to, for example and without limitation, impair or prevent fluid intrusion the interior channel of tensioning anchor 10 or tendon 50. In some embodiments, one or more detents may be formed in the inner surface of front extension 22 to, for example, retain cap 301 within front extension 22. In some embodiments, front extension 22 may further include an annular groove formed in its inner surface. In such an embodiment, cap 301 may have a slightly larger diameter than the inner diameter of front extension 22, allowing cap 301 to be retained in front extension 22 by the groove.

In some embodiments, cap 301 may include internal flange 309. Internal flange 309 may extend into anchor 10 from cap 301 along the outer surface of tendon 50. Internal flange 309 may assist with fluid intrusion the interior channel of tensioning anchor 10 or tendon 50 by, for example, increasing the contact length between cap 301 and tendon 50.

Figure 4A:
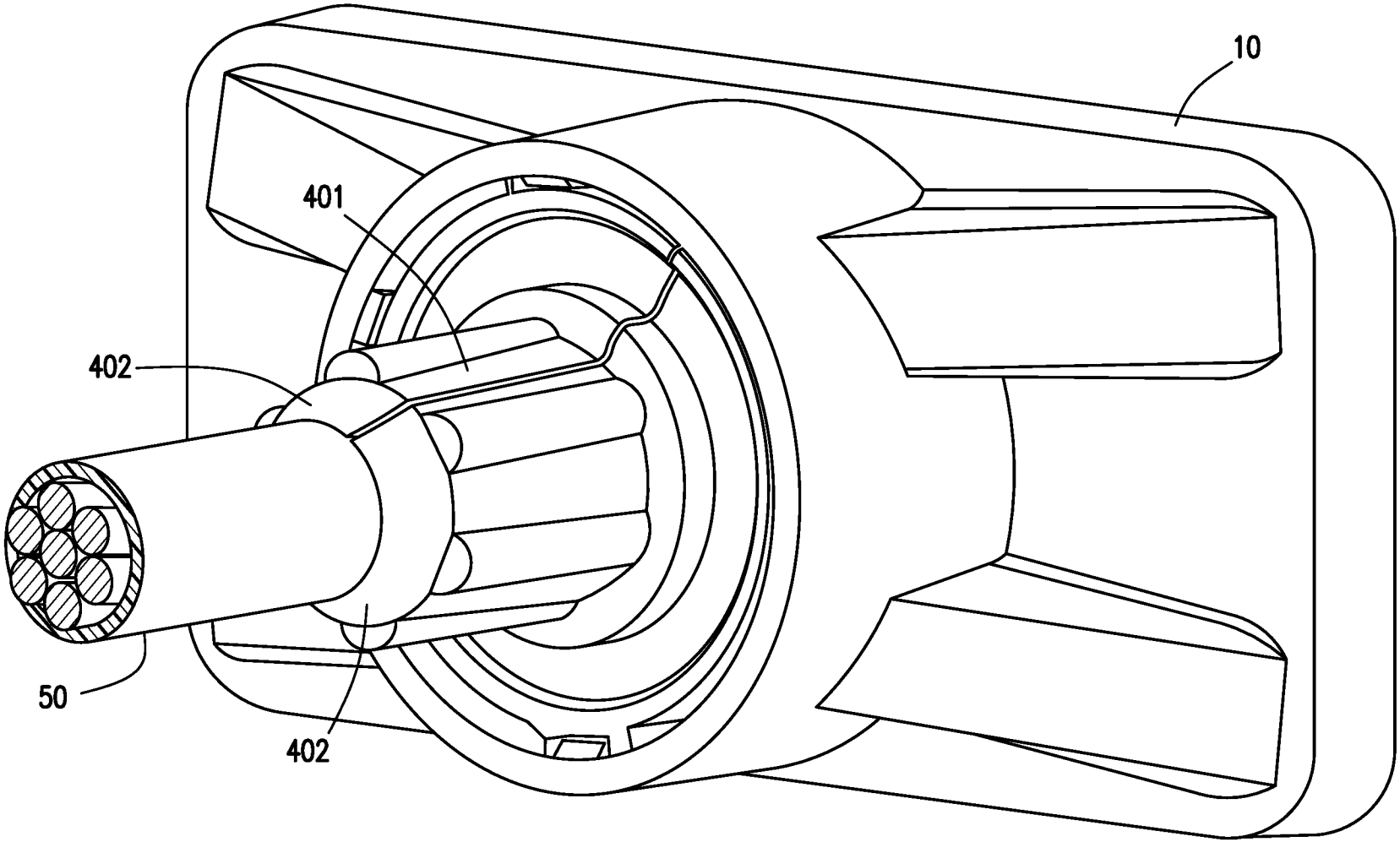
FIG. 4A is a perspective view of an anchor for post-tensioned concrete members fitted with a cap consistent with at least one embodiment of the present disclosure.
Figure 4B:
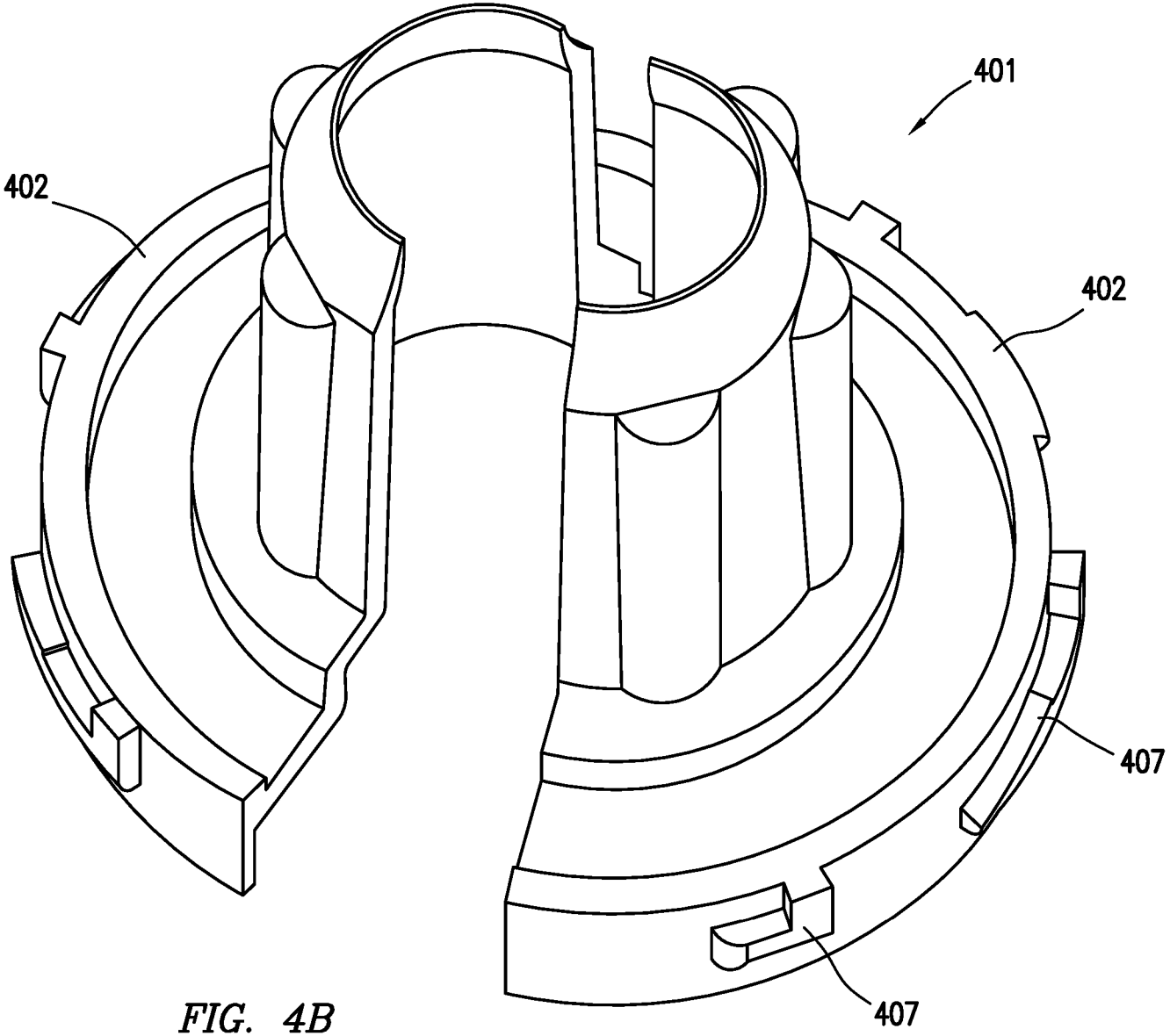
FIG. 4B is a perspective view of the cap of FIG. 4A.

In some embodiments, as depicted in FIGS. 4A, 4B, cap 401 may be formed from two or more cap body subcomponents 402. Cap body subcomponents 402 may be installed about the outer surface of tendon 50 from the side such that they generally continuously form cap 401, allowing cap 401 to be installed around tendon 50 without threading it from the end. Cap 401 may then be installed into anchor 10 as previously described. In some embodiments, cap body subcomponents 402 may abut as depicted in FIG. 4A. In some embodiments, cap body subcomponents 402 may at least partially overlap. In some embodiments, cap body subcomponents 402 may include one or more coupler or positioning features, not shown, which may be utilized to align cap body subcomponents 402 relative to each other or form a seal therebetween. The positioning feature may include a tongue-and-groove, pegs and holes, overlapping flanges, etc.

In some embodiments, cap 401 may be formed as a single unit, but may be slit such that it may likewise be installed about the outer surface of tendon 50 from the side. Although depicted as utilizing bayonet ramps 407, one having ordinary skill in the art with the benefit of this disclosure will understand that the described configurations may each utilize any coupler herein described or known in the art to couple to anchor 10.

In some embodiments, the cap may be formed from a polymer by, for example, injection molding. In some embodiments, although not depicted, the cap may include one or more structural elements positioned to, for example, increase the strength of the cap. Structural elements, as understood in the art, may include ribs, fillets, or stems. In some embodiments, the cap may be split to, for example, allow for easier installation onto the tendon.

In certain embodiments, wedges may be used to hold tendon 50. Prior to wedge installation, temporary cap 101 may be removed. As shown in FIG. 1, to couple tendon 50 to anchor body 12, one or more wedges 60 may be positioned within a conical recess 62 formed in anchor body 12. When tendon 50 is pulled by tensile loading into anchor body 12, wedges 60 are pulled into conical recess 62, and thereby transfer the tensile loading into anchor body 12. Before tendon 50 is tensioned and cut to length, tendon 50 may extend from front extension 22 of tensioning anchor 10.

Before or after tensioning and wedge installation, but before tendon 50 is cut to length, time may pass when it is possible for contaminating fluids such as water or other corrosive fluids to enter the interior channel of tensioning anchor 10 or the interior of tendon 50 from exposure to the surrounding environment. In these circumstances, temporary cap 101 may be positioned on tendon 50 as described herein above. When it becomes time to cut tendon 50 to length, temporary cap 101 may be removed and tendon 50 cut to length.

Although discussed and depicted as separate embodiments, one having ordinary skill in the art with the benefit of this disclosure will understand that various features of each cap discussed above may be combined in ways other than explicitly described without deviating from the scope of this disclosure. Furthermore, although a specific configuration of anchor is discussed, one having ordinary skill in the art with the benefit of this disclosure will understand that the caps discussed herein may be reconfigured to a different anchor configuration, including shape, diameter, or other feature of the different anchor.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A system for inhibiting fluid intrusion into a post-tensioned concrete member comprising:

a concrete member;

a tensioning end anchor embedded in the concrete member and having an interior channel therethrough, the tensioning end anchor including a front extension and being positioned within the concrete member such that the front extension is generally positioned at an edge of the concrete member;

a tendon embedded in the concrete member and threaded through the interior channel of the tensioning end anchor such that a tensioning end portion of the tendon extends from the tensioning end anchor; and a removable cap, the removable cap including a cap body, the cap body having an inner bore therethrough, the inner bore adapted to allow the tendon to pass through the cap body, the removable cap adapted to receive the tensioning end portion of the tendon through the inner bore and to abut and cover the end of the front extension of the tensioning end anchor so as to inhibit the intrusion of fluid into the interior channel while allowing the tensioning end portion of the tendon to pass through the cap body.

2. The system of claim 1 wherein the cap body has an outer diameter generally corresponding to an outer diameter of the front extension of the tensioning end anchor so that the cap body covers the interior channel of the tensioning end anchor.

3. The system of claim 1 wherein the cap body is held to the front extension of the tensioning end anchor by frictional force between the cap body and the tendon.

4. The system of claim 1 wherein the cap body has an outer diameter generally corresponding to an inner diameter of the front extension of the tensioning end anchor so that the cap body fits into the front extension of the tensioning end anchor.

5. The system of claim 1 wherein the front extension of the tensioning end anchor further comprises an annular groove formed on an inner surface of the front extension so that the cap body fits into the annular groove.

6. The system of claim 1 wherein the cap body includes one or more cap bayonet ramps positioned on the outer surface of the cap body, the cap bayonet ramps positioned to couple to corresponding tensioning end anchor bayonet ramps positioned on the inner surface of the front extension of the tensioning end anchor to selectively retain the cap body within the front extension of the tensioning end anchor.

7. The system of claim 6 wherein the removable cap further comprises at least one rotation feature positioned to assist rotation of the removable cap to engage the cap bayonet ramps with the tensioning end anchor bayonet ramps.

8. The system of claim 7 wherein the rotation feature is selected from one of: raised ridges formed on a protrusion from the cap body; a square, hexagonal, splined, or other polygonal protrusion from the cap body; one or more wrenching points formed on a protrusion from the cap body; or one or more holes formed in the removable cap positioned to accept a tool.

9. The system of claim 1 further comprising a seal positioned between the cap body and the tensioning end anchor.

10. The system of claim 1 wherein the removable cap further comprises an inner flange, the inner flange being a generally tubular extension of the cap body, the inner flange having an inner diameter generally the same size as the diameter of the inner bore.

11. The system of claim 10 wherein the inner flange extends away from the tensioning end anchor.

12. The system of claim 10 wherein the inner flange extends toward the tensioning end anchor.

13. The system of claim 1 wherein the removable cap further comprises an outer flange, the outer flange being a generally tubular extension of the cap body, the outer flange having an outer diameter generally corresponding to the outer diameter of the cap body.

14. The system of claim 1 wherein the cap body is formed from two or more cap subcomponents.

15. The system of claim 1 wherein the cap body is formed as a single generally annular member.

16. The system of claim 15 wherein the cap body includes a radial split, the radial split allowing the tendon to be inserted into the inner bore from a side.

17. The system of claim 1, further including at least two wedges disposed in the interior channel of the tensioning end anchor adjacent to the tendon.

18. The system of claim 17 wherein the removable cap prevents intrusion of fluid between the wedges.

19. A system for inhibiting fluid intrusion into a post-tensioned concrete member comprising:

a concrete member;

a tensioning end anchor embedded in the concrete member and having an interior channel therethrough, the tensioning end anchor including a front extension and being positioned within the concrete member such that the front extension is generally positioned at an edge of the concrete member;

a tendon embedded in the concrete member and threaded through the interior channel of the tensioning end anchor such that a tensioning end portion of the tendon extends from the tensioning end anchor; and a removable cap, the removable cap including a cap body, the cap body having an inner bore therethrough, the inner bore having a diameter that is substantially the same as a diameter of the tendon and being adapted to allow the tendon to pass through the cap body, the removable cap adapted to receive the tensioning end portion of the tendon through the inner bore and to abut and cover the end of the front extension of the tensioning end anchor so as to inhibit the intrusion of fluid into the interior channel while allowing the tensioning end portion of the tendon to pass through the cap body.

* * * * *